US007644808B2

(12) United States Patent
Yoshikawa

(10) Patent No.: US 7,644,808 B2
(45) Date of Patent: Jan. 12, 2010

(54) DOOR DEVICE OF ELEVATOR

(75) Inventor: Masami Yoshikawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 511 days.

(21) Appl. No.: 10/574,614

(22) PCT Filed: Jun. 22, 2004

(86) PCT No.: PCT/JP2004/009075

§ 371 (c)(1),
(2), (4) Date: Apr. 5, 2006

(87) PCT Pub. No.: WO2005/123563

PCT Pub. Date: Dec. 29, 2005

(65) Prior Publication Data

US 2008/0230323 A1 Sep. 25, 2008

(51) Int. Cl.
*B66B 13/14* (2006.01)

(52) U.S. Cl. ..... 187/316; 187/315; 187/351; 187/359; 187/361; 187/371

(58) Field of Classification Search ..... 187/351, 187/359, 361, 371
See application file for complete search history.

(56) References Cited

U.S. PATENT DOCUMENTS 3,554,326 A * 1/1971 Hallene et al. ..... 187/324
4,299,308 A * 11/1981 Shung et al. ..... 187/316
4,300,663 A * 11/1981 Hmelovsky et al. ..... 187/316
4,342,379 A * 8/1982 Games et al. ..... 187/316
4,455,517 A * 6/1984 Mitchell ..... 318/283
4,491,199 A * 1/1985 Shea et al. ..... 187/316
5,290,975 A * 3/1994 Mizuno et al. ..... 187/247
5,329,075 A * 7/1994 Hirabayashi et al. ..... 187/316
5,636,715 A * 6/1997 Hayashi et al. ..... 187/330
5,696,362 A * 12/1997 Amend ..... 187/317
5,813,498 A 9/1998 Hattori et al.
5,817,993 A * 10/1998 Kamani et al. ..... 187/316
6,328,133 B1 * 12/2001 Kim ..... 187/319
6,481,533 B1 * 11/2002 Iwasa ..... 187/296
2001/0045327 A1 * 11/2001 Shemanske et al. ..... 187/317
2003/0000777 A1 * 1/2003 Lence Barreiro et al. .... 187/391
2006/0070821 A1 * 4/2006 Grundmann ..... 187/316

FOREIGN PATENT DOCUMENTS

CA 2 458 221 3/2003

(Continued)

*Primary Examiner*—Bentsu Ro
*Assistant Examiner*—Kawing Chan
(74) *Attorney, Agent, or Firm*—Oblon, Spivak, McClelland, Maier & Neustadt, L.L.P.

(57) ABSTRACT

In an elevator door apparatus, an elevator door is capable of reciprocating between a door closure position for closing an elevator entrance and a door open position for opening the elevator entrance. The elevator door is driven by a door drive device. The door drive device is controlled by a door control device. The door control device adjusts the door open position based on control information for controlling an operation of an elevator, obtains a door opening/closing pattern for the elevator door to be opened and closed between the adjusted door open position and the door closure position, and controls the door drive device so that the elevator door is reciprocated in accordance with the obtained door opening/closing pattern.

14 Claims, 7 Drawing Sheets

FOREIGN PATENT DOCUMENTS

| | | | | |
|---|---|---|---|---|
| GB | 2 272 079 | | | 5/1994 |
| JP | 56-23188 | | | 3/1981 |
| JP | 5-139634 | | | 6/1983 |
| JP | 3-28181 | | | 2/1991 |
| JP | 6-100259 | | | 4/1994 |
| JP | 6-135669 | | | 5/1994 |
| JP | 7-97166 | | | 4/1995 |
| JP | 8-324937 | | | 12/1996 |
| JP | 11-209043 | | | 8/1999 |
| JP | 2001-171958 | | | 6/2001 |
| JP | 2001226059 | A | * | 8/2001 |

* cited by examiner

DOOR DEVICE OF ELEVATOR

TECHNICAL FIELD

The present invention relates to an elevator door apparatus for opening and closing an entrance of an elevator.

BACKGROUND ART

JP 11-209043 A discloses an elevator door controller that temporarily stops the running of a door upon detecting an abnormality in the running of the door and then causes the door to run to a full open or full closure position under low torque. The presence/absence of an abnormality in the running of the door is determined based on a signal from a rotary encoder for detecting the position and speed of the door. Accordingly, when there is no abnormality in the running of the door, the door is not stopped between the full open position and the full closure position.

In large complex office buildings and the like, for example, elevator apparatuses equipped with large-capacity elevator cars for transporting a large number of passengers at once are increasingly installed in recent years in order to cope with the peak-time usage. Such elevator apparatuses are provided with an entrance having a large width so as to allow boarding and alighting of a large number of passengers.

However, even during the normal operation time when the elevator is often run with a small number of passengers aboard, the door open/close time remains the same as that during the peak time even through the time it takes for the passengers to board or alight from the elevator becomes shorter. Hence, the efficiency of elevator operation decreases as a result.

DISCLOSURE OF THE INVENTION

The present invention has been made with a view to solving the above-mentioned problem, and therefore it is an object of the present invention to provide an elevator door apparatus which makes it possible to enhance the efficiency of elevator operation.

An elevator door apparatus according to the present invention includes: an elevator door capable of reciprocating between a door closure position for closing an elevator entrance and a door open position for opening the elevator entrance; a door drive device for driving the elevator door; and a door control device for adjusting the door open position based on control information for controlling an operation of an elevator, obtaining a door opening/closing pattern for the elevator door to be opened and closed between the adjusted door open position and the door closure position, and controlling the door drive device so that the elevator door is reciprocated in accordance with the obtained door opening/closing pattern.

BEST MODE FOR CARRYING OUT THE INVENTION

Hereinbelow, preferred embodiments of the present invention will be described with reference to the drawings.

Embodiment 1

Figure 1:
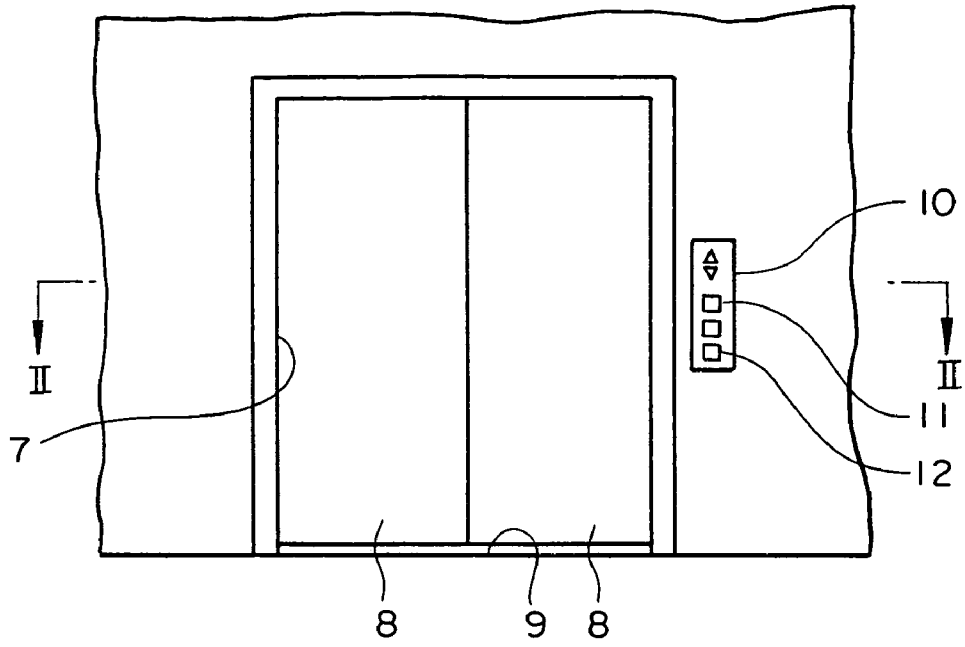
FIG. 1 is a front view showing an elevator door apparatus according to Embodiment 1 of the present invention.
Figure 2:
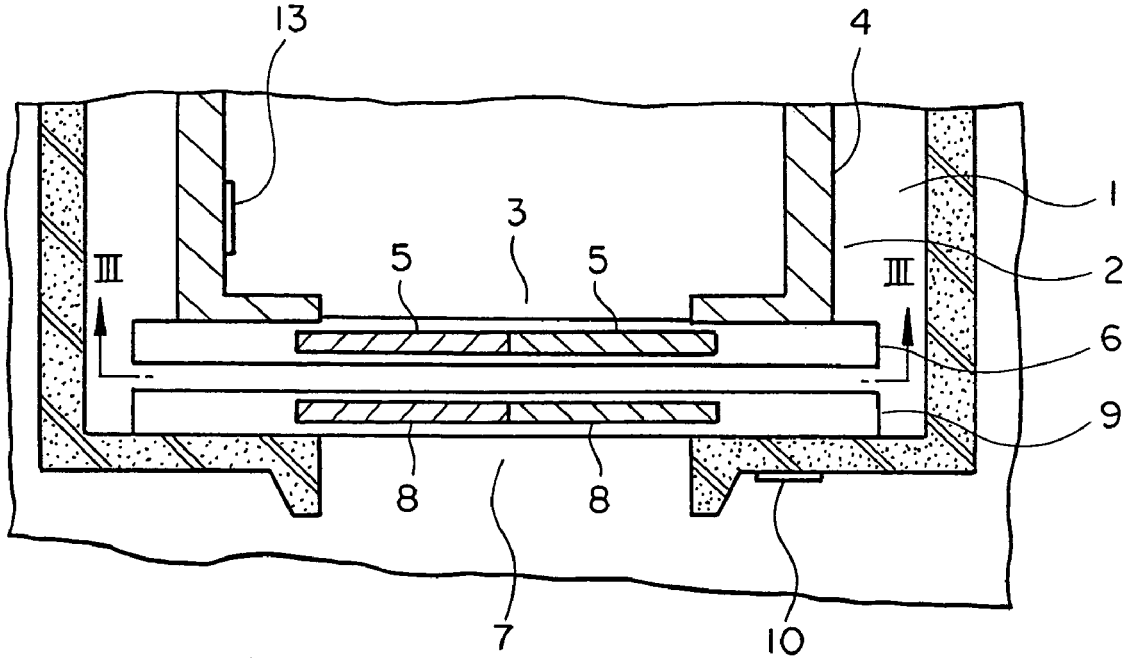
FIG. 2 is a sectional view taken along the line II-II of FIG. 1.
Figure 3:
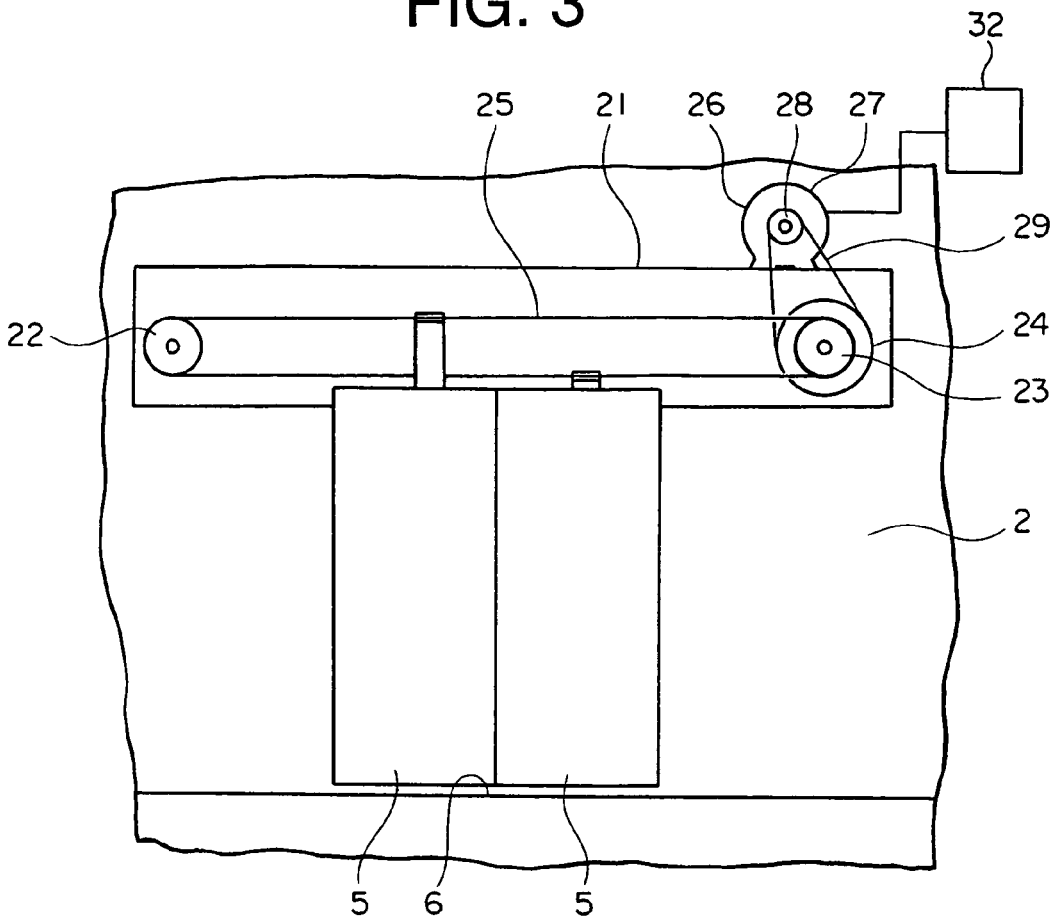
FIG. 3 is a sectional view taken along the line III-III of FIG. 2.

FIG. 1 is a front view showing an elevator door apparatus according to Embodiment 1 of the present invention. Further, FIG. 2 is a sectional view taken along the line II-II of FIG. 1, and FIG. 3 is a sectional view taken along the line III-III of FIG. 2. Referring to the drawings, a car 2 that can travel in the vertical direction is provided within a hoistway 1. The car 2 has: a car main body 4 provided with a car entrance 3; and a pair of car doors 5 mounted on the car main body 4, for opening/closing the car entrance 3. A horizontally extending car sill 6 is arranged below each of the car doors 5. The car sill 6 is provided in a lower portion of the car entrance 3 (FIG. 2).

A door case 21 that is a horizontally extending support member is arranged above the car entrance 3. The door case 21 is fixed to the car main body 4. Each car door 5 is suspended from the door case 21. Further, each car door 5 is capable of reciprocating along the door case 21 in the width direction of the car entrance 3.

A rotatable first pulley 22 is provided at one end portion of the door case 21. Further, provided at the other end portion of the door case 21 are a second pulley 23 and a transmitting pulley 24 that are capable of rotating coaxially. The second pulley 23 and the transmitting pulley 24 are rotated integrally with each other. An annular moving belt 25 is wound between the first and second pulleys 22, 23. An upper portion of each car door 5 is connected to the moving belt 25 (FIG. 3).

Disposed in an upper portion of the car 2 is a door drive device 26 for causing the car doors 5 to reciprocate. The door drive device 26 has a motor 27 for generating a rotational drive force, and a drive pulley 28 that is rotated by the motor 27. An annular transmission belt 29 is wound between the drive pulley 28 and the transmitting pulley 24. The torque of the drive pulley 28 is transmitted to the transmitting pulley 24 and the second pulley 23 by means of the transmission belt 29. The moving belt 25 is rotated through the rotation of the second pulley 23, thereby causing the car doors 5 to move in opposite directions (FIG. 3).

At each floor, there is provided a landing entrance 7 communicating a landing 51 with the inside of the hoistway 1. Each landing entrance 7 is provided with a pair of landing doors 8 for opening and closing the landing entrance 7. A horizontally extending landing sill 9 is arranged under the landing doors 8. The landing sill 9 is provided in a lower portion of the landing entrance 7.

Each landing door 8 is capable of engaging with each car door 5 by means of an engaging device (not shown). Each car door 5 and each landing door 8 are capable of reciprocating integrally as an elevator door 52 through their engagement with each other by the engaging device. Further, when the car 2 is being stopped at a landing floor, the car entrance 3 and the landing entrance 7 form an elevator entrance 53 for communicating the inside of the car 2 with the landing 51. As it is driven by the door drive device 26, the elevator door 52 is reciprocated between a door close position for closing the elevator entrance 53 and a door open position for opening the elevator entrance 53.

A landing operation panel 10 is provided in a wall surface by the side of the landing entrance 7. The landing operation panel 10 is provided with a call button for calling the car 2, a full open/close button 11 as an operation switch for setting the door open position of the elevator door 52 to a full open position for fully opening the elevator entrance 53, and a half open/close button 12 as an operation switch for setting the door open position of the elevator door 52 to a half open position that is located on the door close position side with respect to the full open position.

An in-car operation panel 13 is provided in an inner wall surface of the car main body 4. The in-car operation panel 13 is provided with a plurality of destination buttons for designating destination floors, an open/close button for opening and closing the elevator door 52, and a full open/close button and a half open/close button that are the same as the operation switches described above (neither of which is shown).

Provided in a lower portion of the car 2 is a weighing device 44 (FIG. 6) for generating a signal in accordance with the size of the weight load inside the car 2. The weighing device is adapted to measure the weight placed on the floor inside the car 2. It should be noted that the weighing device may be adapted to measure the magnitude of the tensile force in a main rope suspending the car 2.

Provided within the hoistway 1 is an elevator control device 33 (FIG. 6) for controlling the operation of an elevator. Operation information 36 (FIG. 6) from the landing operation panel 10 and the in-car operation panel 13 and weight information 37 (FIG. 6) from the weighing device are input to the elevator control device 33 as control information. The elevator control device 33 is adapted to control the operation of the elevator based on the control information.

The car 2 is mounted with a door control device 32 for controlling the door drive device 26. Control information from the elevator control device 33 is input to the door control device 32. The door control device 32 is adapted to control the door drive device 26 based on the control information from the elevator control device 33.

Figure 4:
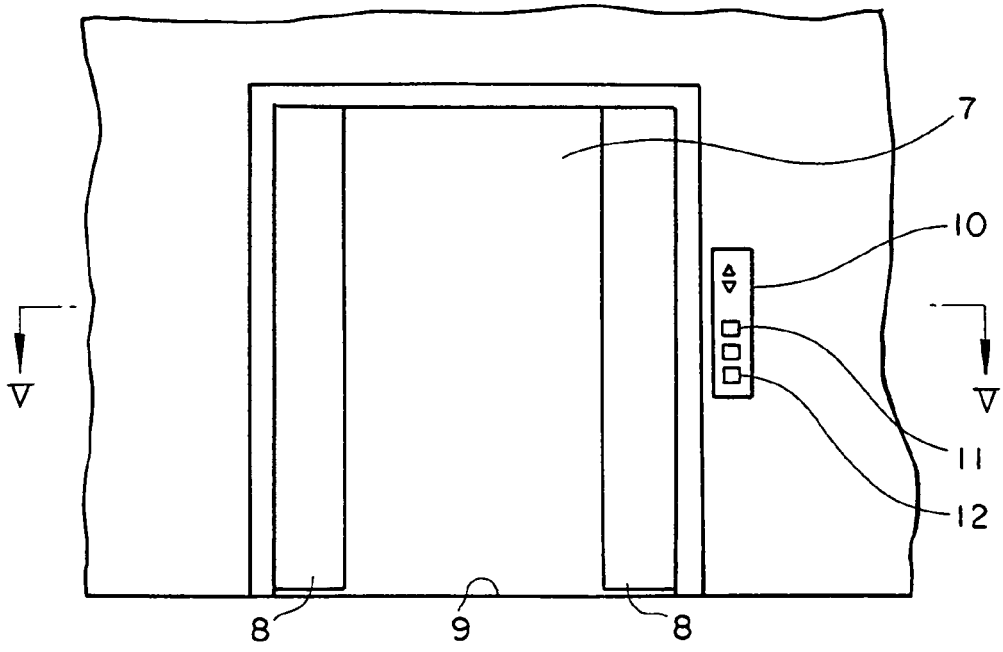
FIG. 4 is a front view showing the elevator door apparatus with the elevator door shown in FIG. 1 in its half open position.
Figure 5:
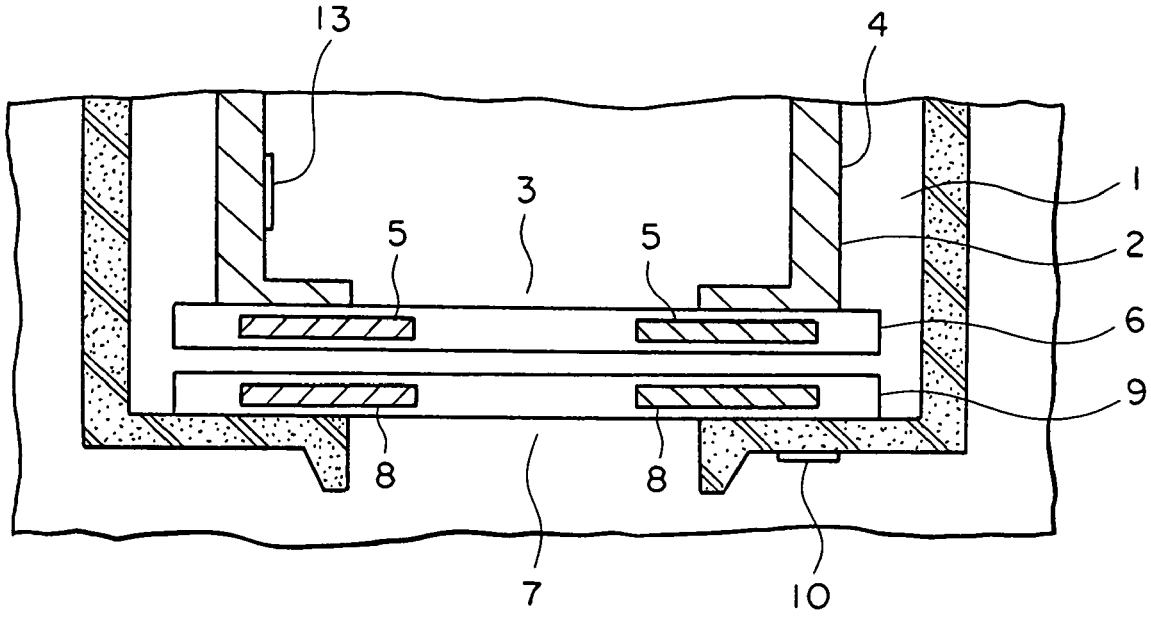
FIG. 5 is a sectional view taken along the line V-V of FIG. 4.

FIG. 4 is a front view showing the elevator door apparatus with the elevator door 52 shown in FIG. 1 in its half open position. Further, FIG. 5 is a sectional view taken along the line V-V of FIG. 4. As shown in the drawings, when the full open/close button 11 is being selected, the door open position of the elevator door 52 is set to the full open position for fully opening the elevator entrance 53; when the half open/close button 12 is being selected, the door open position of the elevator door 52 is set to the half open position located on the inner side with respect to the full open position. That is, when the full open/close button 11 is being selected, the elevator door 52 is reciprocated between the door closure position and the full open position as the elevator entrance 53 is opened and closed; when the half open/close button 12 is being selected, the elevator door 52 is reciprocated between the door closure position and the half open position as the elevator entrance 53 is opened and closed.

Figure 6:
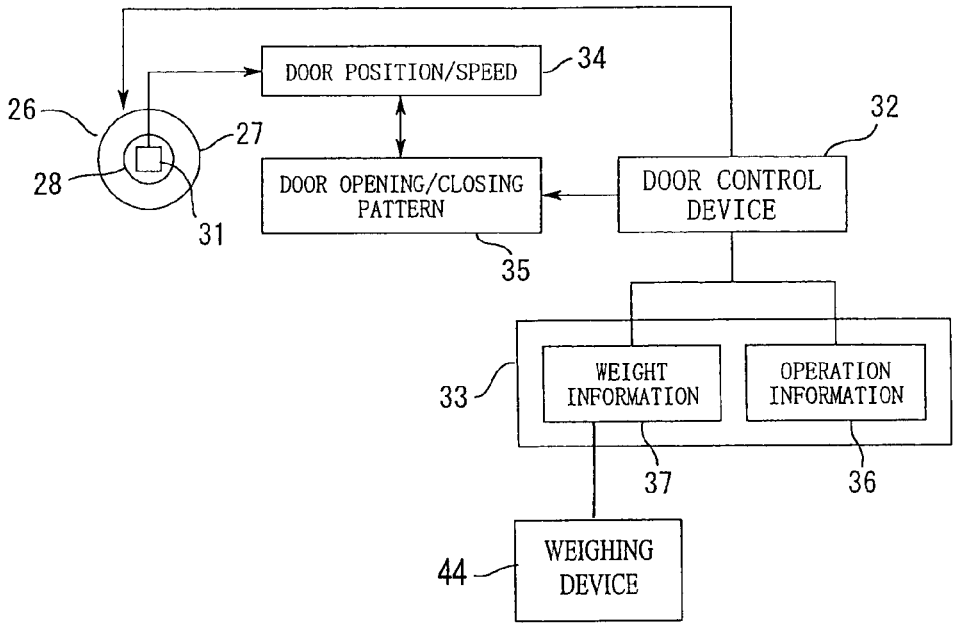
FIG. 6 is a block diagram showing a main portion of the elevator door apparatus shown in FIG. 3.
Figure 11:
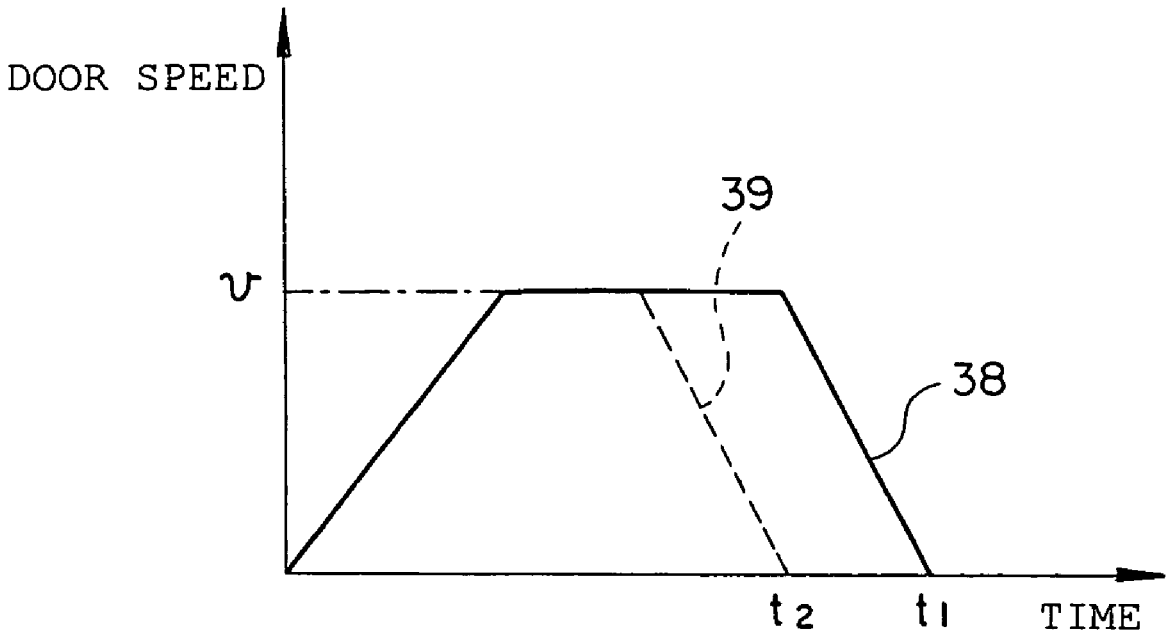
FIG. 11 is a graph showing a door opening/closing pattern for the elevator door created by the door control device shown in FIG. 6.

FIG. 6 is a block diagram showing a main portion of the elevator door apparatus shown in FIG. 3. Further, FIG. 11 is a graph showing a door opening/closing pattern for the elevator door 52 created by the door control device 32 shown in FIG. 6. Referring to the drawings, the door control device 32 is adapted to create the door opening/closing pattern as a control pattern for reciprocating the elevator door 52 based on the control information from the elevator control device 33, that is, the operation information 36 and the weight information 37. That is, when the full open/close button 11 of at least one of the landing operation panel 10 and the in-car operation panel 13 is being selected, the door control device 32 creates a door closing/opening pattern for full open/close operation 38 (indicated by the solid line of FIG. 11) for reciprocating the elevator door 52 such that the door open position of the elevator door 52 becomes the full open position. Further, when the full open/close button 11 is not being selected, that is, when the half open/close button 12 of each of the landing operation panel 10 and the in-car operation panel 13 is being selected, the door control device 32 creates a door opening/closing pattern for half open/close operation 39 (indicated by the broken line of FIG. 11) for reciprocating the elevator door 52 such that the door open position of the elevator door 52 becomes the half open position.

Accordingly, as shown in FIG. 11 time t2 it takes for the elevator door 52 to move between the door closure position and the door open position when the door drive device 26 is controlled in accordance with the door opening/closing pattern for half open/close operation 39 becomes shorter than time t1 it takes for the elevator door 52 to move between the door closure position and the door open position when the door drive device 26 is controlled in accordance with the door opening/closing pattern for full open/close operation 38.

Further, when creating the door opening/closing pattern for half open/close operation 39, the door control device 32 adjusts the half open position based on the weight information from the weighing device. Accordingly, the half open position is adjusted so as to be closer to the full open position as the weight load inside the car 2 becomes larger, and to be away from the full open position toward the inner side in the with direction as the weight load inside the car 2 becomes smaller.

The drive pulley 28 is provided with a rotary encoder 31 as a detector for generating a signal (which in this example is a pulse signal) in accordance with the rotation of the drive pulley 28. The pulse signal from the rotary encoder 31 is input to the door control device 32.

The door control device 32 determines the position of the elevator door 52 from the number of pulse signals generated, and determines the speed of the elevator door 52 from the generation rate of the pulse signals. Further, the door control device 32 controls the drive of the door drive device 26 so that the elevator door 52 is reciprocated in accordance with the door opening/closing pattern 35, while comparing position and speed 34 of the elevator door 52 determined on the basis of the information from the rotary encoder 31 with the door opening/closing pattern 35 created on the basis of the control information from the elevator control device 33.

Next, operation will be described. When the full open/close button 11 of at least one of the landing operation panel 10 and the in-car operation panel 13 is being selected, the signal from the full open/close button 11 is input to the door control device 32 through the elevator control device 33. Accordingly, the door opening/closing pattern for full open/close operation 38 is created by the door control device 32. Further, the door control device 32 also determines the position and speed 34 of the elevator door 52 based on the information from the rotary encoder 31.

Thereafter, while comparing the position and speed 34 of the elevator door 52 with the door opening/closing pattern for full open/close operation 38, the door control device 32 controls the door drive device 26 so that the elevator door 52 is reciprocated in accordance with the door opening/closing pattern for full open/close operation 38. As a result, the elevator door 52 is reciprocated between the door closure portion and the full open position according to a speed change in conformity with the door opening/closing pattern for full open/close operation 38.

When the half open/close button 12 of each of the landing operation panel 10 and the in-car operation panel 13 is being selected, the signal from the half open/close button 12 is input to the door control device 21 through the elevator control device 33. Accordingly, the door opening/closing pattern for half open/close operation 39 is created by the door control device 32 based on the information from the door control device 32. Further, the door control device 32 also determines the position and speed 34 of the elevator door 52 based on the information from the rotary encoder 31.

Thereafter, while comparing the position and speed 34 of the elevator door 52 with the door opening/closing pattern for half open/close operation, the door control device 32 controls the door drive device 26 so that the elevator door 52 is reciprocated in accordance with the door opening/closing pattern for half open/close operation 39. As a result, the elevator door 52 is reciprocated between the door closure portion and the full open position according to a speed change in conformity with the door opening/closing pattern for full open/close operation 39.

In the elevator door apparatus as described above, the door control device 32 obtains the door opening/closing pattern 35 with the door closure position of the elevator door 52 adjusted based on the control information for controlling the operation of the elevator, and controls the door drive device 26 such that the elevator door 52 is reciprocated according to a speed change in conformity with the door opening/closing pattern 35 thus obtained. Accordingly, the control on the operation of opening/closing the elevator entrance 53 can be carried out in accordance with the operation status of the elevator, thereby making it possible to prevent the opening/closing width of the elevator door 52 from becoming unnecessarily large. As a result, the open/close time for the elevator entrance 53 by the elevator door 52 can be shortened, thereby making it possible to enhance the efficiency of elevator operation.

Further, the door control device 32 obtains the door opening/closing pattern based on the weight information from the weighing device that generates the signal in accordance with the size of the weight load inside the car 2, thereby making it possible to adjust the width of the elevator entrance 53 to be opened and closed by the elevator door 52 in accordance with the size of the weight load inside the car 2. As a result, the opening/closing width can be adjusted in accordance with the number of passengers inside the car 2, so the open/close time by the elevator door 52 can be shortened when the number of passengers is small. Accordingly, it is possible to enhance the efficiency of elevator operation.

Further, the full open/close button 11 and the half open/close button 12 are provided both inside the car 2 and in the landing 51, whereby one of the full open position and the half open position can be set as the door open position of the elevator door 52 by selecting one of the full open/close button 11 and the half open/close button 12. Accordingly, in cases where it is desired to fully open the elevator entrance 53 even though the weight load inside the car 2 is small, such as when transporting a wheel chair or other such large-sized load, for example, the elevator entrance 53 can be fully opened by selecting the full open/close button 12, thereby making it possible to prevent the inconvenience that may be caused to the passengers if the elevator door 52 can be opened only to the half open position.

It should be noted that while in the above-described example the full open/close button 11 and the half open/close button 12 are provided in both of the landing operation panel 10 and the in-car operation panel 13, the full open/close button 11 and the half open/close button 12 may be provided only in one of the landing operation panel 10 and the in-car operation panel 13.

Embodiment 2

Figure 7:
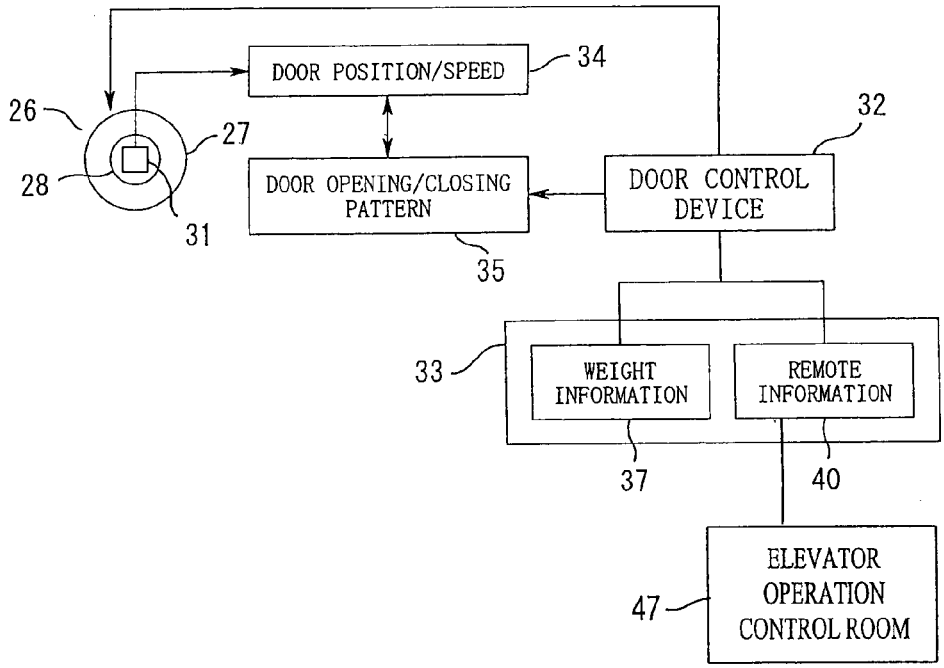
FIG. 7 is a block diagram showing a main portion of an elevator door apparatus according to Embodiment 2 of the present invention.

FIG. 7 is a block diagram showing a main portion of an elevator door apparatus according to Embodiment 2 of the present invention. While in the above-described example the door open position of the elevator door 52 is set to be one of the full open position and the half open position by operating the full open/close button 11 and the half open/close button 12 that are provided in each of the landing operation panel 10 and the in-car operation panel 13, the selection for setting the door open position of the elevator door 52 to one of the full open position and the half open position may be effected through remote operation from an elevator control room 47 for controlling the operation of the elevator. In this case, remote information 40 in the form of a signal due to the remote operation is input to the door control device 32 via the elevator control device 33.

In this way, the door closure position of the elevator door 52 can be adjusted as a part of the operation control of the entire elevator apparatus, thereby making it possible to enhance the efficiency of elevator operation.

Embodiment 3

Figure 8:
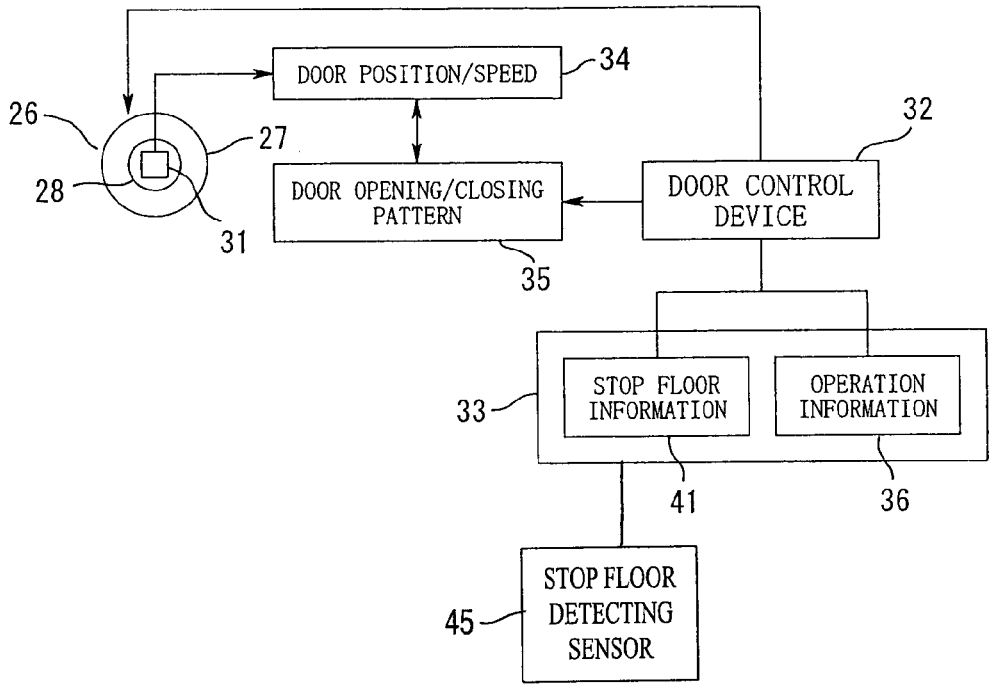
FIG. 8 is a block diagram showing a main portion of an elevator door apparatus according to Embodiment 3 of the present invention.

FIG. 8 is a block diagram showing a main portion of an elevator door apparatus according to Embodiment 3 of the present invention. While in Embodiment 1 the half open position of the elevator door 52 is adjusted based on the weight information 37 from the weighing device 44 (FIG. 6), the half open position of the elevator door 52 may be adjusted based on stop floor information 41 from a stop floor detecting sensor 45 for detecting the floor at which the car 2 stops.

In this embodiment, the door open position adapted for the number of passengers using the elevator at each floor is set in the door control device 32 in advance in correspondence with each floor. Further, the stop floor information 41 from the stop floor detecting sensor 45 is input to the door control information 32 via the elevator control device 33 as control information, whereby the door control device 32 creates the door opening/closing pattern 35 for the elevator door 52 to be opened and closed between the door open position and the door closure position which corresponds to the floor at which the car 2 stops. Otherwise, Embodiment 3 is of the same configuration as Embodiment 1.

In this way, for example, the opening/closing width of the elevator door 52 can be adjusted to be large at a reference floor (which is usually the lobby floor of a building) where a relatively large number of passengers board the elevator, and the opening/closing width of the elevator door 52 can be adjusted to be small at floors where the number of passengers boarding the elevator is relatively small, thereby making it possible to enhance the efficiency of elevator operation.

Embodiment 4

Figure 9:
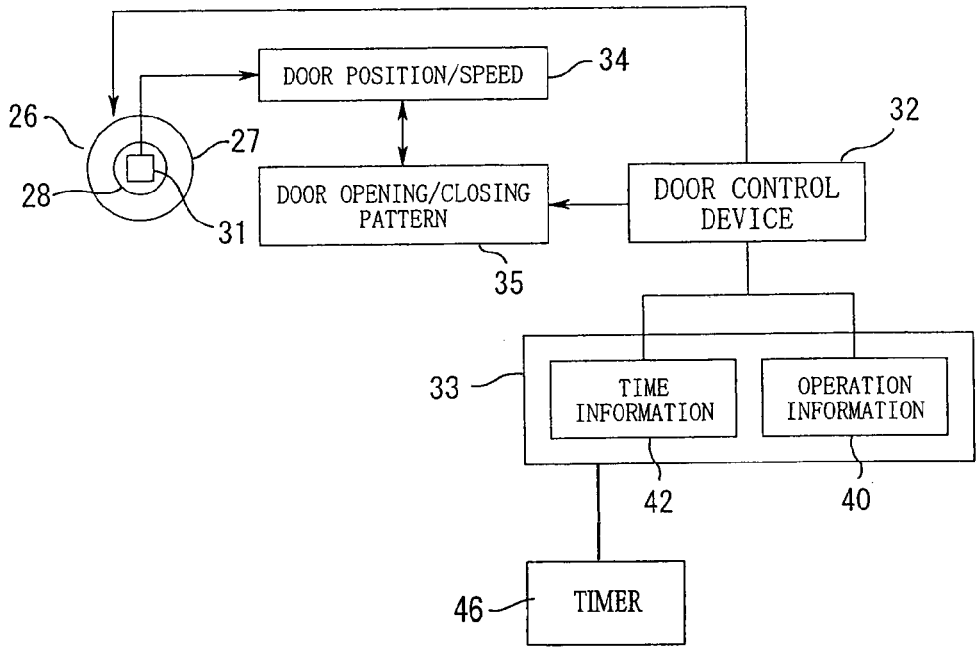
FIG. 9 is a block diagram showing a main portion of an elevator door apparatus according to Embodiment 4 of the present invention.

FIG. 9 is a block diagram showing a main portion of an elevator door apparatus according to Embodiment 4 of the present invention. While in Embodiment 3 the half open position of the elevator door 52 is adjusted based on the stop floor information 41, the half open position of the elevator door 52 may be adjusted based on time information 42 from a timer 46.

In this embodiment, the door open position adapted for the number of passengers using the elevator during each of a plurality of time periods is set in advance in the door control device 32 in correspondence with each of the time periods. Further, the time information 42 from the timer 46 is input as control information to the door control device 32 via the elevator control device 33, whereby the door control device 32 creates the door opening/closing pattern 35 for the elevator door 52 between the door open position and the door closure position which corresponds to the time period to which the time indicated by the timer belongs. Otherwise, Embodiment 4 is of the same configuration as Embodiment 3.

In this way as well, the opening/closing width for the elevator door 52 can be adjusted to be large at a reference floor (which is usually the lobby floor of a building) where a relatively large number of passengers board the elevator, and to be small at floors where the number of passengers boarding the elevator is relatively small, thereby making it possible to enhance the efficiency of elevator operation.

Embodiment 5

Figure 10:
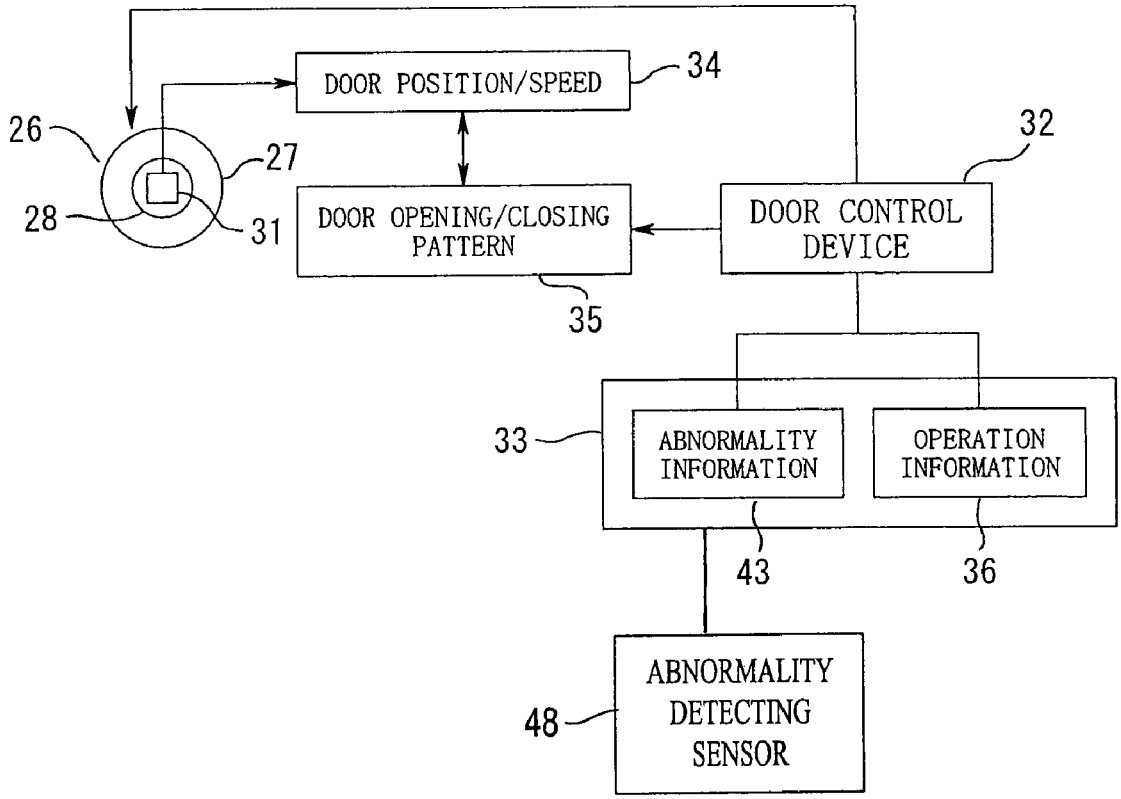
FIG. 10 is a block diagram showing a main portion of an elevator door apparatus according to Embodiment 5 of the present invention.

FIG. 10 is a block diagram showing a main portion of an elevator door apparatus according to Embodiment 5 of the present invention. Abnormality information 43 from a door operation abnormality detecting sensor 48 for detecting an abnormality in the operation of the elevator door 52 is input to the elevator control device 33. The abnormality information 43 from the elevator control device 33 is input as control information to the door control device 32.

The door control device 32 creates the door opening/closing pattern 35 while adjusting as the door open position of the elevator door 52 the position of the elevator door 52 at the time when the abnormality information 43 from the elevator control device 33 is input. The door control device 32 controls the door drive device 26 such that the elevator door 52 is reciprocated between the door closure position and the door open position according to a speed change in conformity with the door opening/closing pattern 35. That is, the elevator door 52 is reciprocated on the inner side in the width direction with respect to the position at which the abnormality has occurred in the operation of the elevator door 52. Otherwise, Embodiment 4 is of the same configuration as Embodiment 1.

In this way, even when it becomes unable to fully open the elevator door 53 due to some abnormality, the elevator entrance 53 can be opened and closed within the area where the elevator door 52 can reciprocate, whereby the operation of the elevator can be continued without being interrupted until the maintenance worker arrives at the location of the elevator apparatus. Accordingly, it is possible to enhance the efficiency of elevator operation.

It should be noted that while in the above-described embodiments only the full open/close button 11 and the half open/close button 12 are provided in each of the landing operation panel 10 and the in-car operation panel 13 as the operation switches to be operated for controlling the operation of the elevator door 52, the landing operation panel 10 and the in-car operation panel 13 may each be provided with an additional full open button for moving the elevator door 52 from the half open position to the full open position when the elevator door 52 is stopped at the half open position.

Further, while in the above-described embodiments the two kinds of control information are input to the door control device 32, the control information of the above respective embodiments may be combined with each other so that more than three kinds of control information may be input to the door control device 32.

The invention claimed is:

1. An elevator door apparatus comprising:

an elevator door configured to move between a door closure position that closes an elevator entrance, a first open door position that opens the elevator entrance to a first open door width, a second open door position that opens the elevator entrance to a second open door width greater than the first open door width, and a fully open door position that opens the elevator entrance to a fully open door width greater than the second open door width;

a timer configured to produce time information;

a door drive device configured to drive the elevator door; and a door control device configured to store time information and corresponding door opening position information, select one of the first, second, and fully open door positions based on control information for controlling an operation of an elevator including the stored door opening position information that corresponds to the time information produced by the timer, and control the door drive device to stop moving the elevator door at the selected door open position.

2. An elevator door apparatus according to claim 1, further comprising:

a weighing device configured to generate a weight signal in accordance with a size of a weight load in a car and produce, based on the weight signal, weight information that is input to the door control device as the control information; and the door control device is further configured to select one of the first and second open door positions as the selected door open position based on the weight information in the control information.

3. An elevator door apparatus according to claim 1, further comprising:

a plurality of destination buttons provided in an inside of a car each configured to designate a destination floor;

a call request button provided in a landing;

an operation device configured to generate a door open position request provided in at least one of an inside of a car and a landing;

the door open position request is input to the door control device as the control information; and the door control device is further configured to select a door open position based on the door open position request in the control information.

4. An elevator door apparatus according to claim 3, wherein the operation device includes a full open request button and a partial open request button.

5. An elevator door apparatus according to claim 1, further comprising:

a stop floor detecting sensor configured to detect a floor at which the car is stopped and produce, based on the detected floor, stop floor information that is input to the door control device as the control information; and the door control device is further configured to select one of the first and second open door positions as the selected door open position based on the stop floor information in the control information.

6. An elevator door apparatus according to claim 5, wherein the door control device is further configured to select the second door open position when the stop floor detecting sensor detects that the car is stopped at a lobby floor of a building.

7. An elevator door apparatus according to claim 1, further comprising:

a remote information receiver configured to receive remote information from an elevator operation control room, the remote information is input to the door control device as the control information; and the door control device is further configured to select one of the first and second open door positions as the selected door open position based on the remote information in the control information.

8. The elevator door apparatus according to claim 1, wherein the door control device is further configured to obtain a door opening speed pattern identifying a variable speed versus time relationship of moving the elevator door between the door closure position and the selected door open position, and control the door drive device to control a moving speed of the elevator door according to the obtained door opening speed pattern.

9. An elevator door apparatus comprising:

an elevator door configured to move between a door closure position that closes an elevator entrance, a first open door position that opens the elevator entrance to a first open door width, a second open door position that opens the elevator entrance to a second open door width greater than the first open door width, and a fully open door position that opens the elevator entrance to a fully open door width greater than the second open door width;

a door drive device configured to drive the elevator door;

a door control device configured to select one of the first, second, and fully open door positions based on control information for controlling an operation of an elevator, and control the door drive device to stop moving the elevator door at the selected door open position;

a timer configured to produce time information that is input to the door control device as the control information; and the door control device is further configured to store correspondence information indicating a correspondence between each of plural predetermined time periods and one of the first and second open door positions, and select one of the first and second open door positions as the selected door open position based on a time period to which the time information indicated by the timer belongs and the corresponding stored door position.

10. An elevator door apparatus comprising:

an elevator door configured to move between a door closure position that closes an elevator entrance, a first open door position that opens the elevator entrance to a first open door width, a second open door position that opens the elevator entrance to a second open door width greater than the first open door width, and a fully open door position that opens the elevator entrance to a fully open door width greater than the second open door width;

a door drive device configured to drive the elevator door;

a door control device configured to select one of the first, second, and fully open door positions based on control information for controlling an operation of an elevator, and control the door drive device to stop moving the elevator door at the selected door open position;

an abnormality detecting sensor configured to detect an abnormality that prevents the elevator door from opening beyond an abnormally limited position and, based on the detected abnormality, to produce abnormality information that is input to the door control device as the control information; and the door control device is further configured to select the abnormally limited position as the selected door open position based on the abnormality information in the control information.

11. An elevator door apparatus comprising:

an elevator door configured to move between a door closure position that closes an elevator entrance, a partially open door position that opens the elevator entrance to a partially open door width, and a fully open door position that opens the elevator entrance to a fully open door width greater than the partially open door width;

a door drive device configured to drive the elevator door;

a door control device configured to select one of the partially open door position and the fully open door position based on control information for controlling an operation of an elevator;

the door control device is further configured, when the partially open door position is selected, to adjust the partially open door width of the partially open door position based on the control information, and control the door drive device to stop moving the elevator door at the adjusted partially open door width;

a timer configured to produce time information that is input to the door control device as the control information; and the door control device is further configured to store correspondence information indicating a correspondence between each of plural predetermined time periods and plural open door positions, and adjust the partially open door width based on a time period to which the time information indicated by the timer belongs and the corresponding stored open door position.

12. An elevator door apparatus according to claim 11, further comprising:

a stop floor detecting sensor configured to detect a floor at which the car is stopped and produce, based on the detected floor, stop floor information that is input to the door control device as the control information; and the door control device is further configured to adjust the partially open door width based on the stop floor information in the control information.

13. An elevator door apparatus according to claim 12, wherein the door control device is further configured to adjust the partially open door width to be closer to the fully open door width when the stop floor detecting sensor detects that the car is stopped at a lobby floor of a building.

14. An elevator door apparatus comprising:

an elevator door configured to move between a door closure position that closes an elevator entrance, a partially open door position that opens the elevator entrance to a partially open door width, and a fully open door position that opens the elevator entrance to a fully open door width greater than the partially open door width;

a door drive device configured to drive the elevator door;

a door control device configured to select one of the partially open door position and the fully open door position based on control information for controlling an operation of an elevator;

the door control device is further configured, when the partially open door position is selected, to adjust the partially open door width of the partially open door position based on the control information, and control the door drive device to stop moving the elevator door at the adjusted partially open door width;

an abnormality detecting sensor configured to detect an abnormality that prevents the elevator door from opening beyond an abnormally limited position and, based on the detected abnormality, to produce abnormality information that is input to the door control device as the control information; and the door control device is further configured to adjust the partially open door width to be the abnormally limited position based on the abnormality information in the control information.

* * * * *